US006470968B1

(12) United States Patent
Turner

(10) Patent No.: US 6,470,968 B1
(45) Date of Patent: Oct. 29, 2002

(54) INDEPENDENTLY RETRIEVABLE SUBSEA TREE AND TUBING HANGER SYSTEM

(75) Inventor: Edwin C. Turner, Euless, TX (US)

(73) Assignee: Kvaerner Oifield Products, Inc., Houston, TX (US)

( * ) Notice: Subject to any disclaimer, the term of this patent is extended or adjusted under 35 U.S.C. 154(b) by 50 days.

(21) Appl. No.: 09/679,901

(22) Filed: Oct. 5, 2000

Related U.S. Application Data

(60) Provisional application No. 60/158,007, filed on Oct. 6, 1999.

(51) Int. Cl.[7] ..... E21B 33/043

(52) U.S. Cl. ..... 166/348; 166/341; 166/368

(58) Field of Search ..... 166/339, 338, 166/341, 343, 348, 360, 368

(56) References Cited

U.S. PATENT DOCUMENTS 4,903,774 A * 2/1990 Dykes et al. ..... 166/363

5,143,158 A * 9/1992 Watkins et al. ..... 166/344

* cited by examiner

*Primary Examiner*—David Bagnell
*Assistant Examiner*—Zakiya Walker
(74) *Attorney, Agent, or Firm*—Buskop Law Group, P.C.; Wendy Buskop

(57) ABSTRACT

A subsea wellhead completion system and method for independently retrieving or deploying a subsea completion with a wellhead housing adapted to be supported on a seabed, a tree atop the wellhead housing with a fine alignment key for aligning the tree with the wellhead housing, a tubing hanger atop the tree with a production and an annular tubing string extending downwardly, numerous ports on the tree, engagable gates to open and close one or more of the ports, a deployable running tool that can manipulate the gates and wherein the tubing hanger is composed of the slidably ignitable gates connected to a way for retracting or extending outer seals of the tubing hanger and provide a blocking position against an inner seal and an unblocking position for fluid communication of the bores with each ports of the tubing hanger tree.

7 Claims, 15 Drawing Sheets

INDEPENDENTLY RETRIEVABLE SUBSEA TREE AND TUBING HANGER SYSTEM

This application claims the benefit of provisional case Ser. No. 60/158,007 file Oct. 6, 1999 now abandoned.

BACKGROUND OF THE INVENTION

This invention relates to a device used to create independently retrievable subsea Christmas trees and subsea tubing hangers for wellheads. Subsea wellheads are typically completed using one of two configurations. In one type of completion, a tree is connected to the wellhead using a tree running tool and a tubing hanger is connected to the tree using a tubing hanger running tool.

Alternatively, in a second type of completion, a tree can be connected to a wellhead and an internal tree cap can be connected to the tree along with a tubing hanger. A tubing hanger running tool connects with the tubing hanger.

The present invention addresses a need arising from the characteristic arrangement of a tubing hanger deployed and landed above a subsea Christmas tree, or a subsea Christmas tree deployed and landed above the tubing hanger. A need has existed for a means to deploy and retrieve a tree leaving a tubing hanger in place and alternatively a method to deploy and retrieve a tubing hanger leaving the tree in place.

The upper end of a wellhead system is closed by any one of a number of devices providing control of fluid flow and pressure entering and or leaving the well. This closing device is typically installed vertically, as a cap attached to an end of one of the wellhead's concentric body cylinders, and which seals fluid pressure at the upper end of one or more of the body cylinders.

The basic function of a wellhead is to provide for fluid flow from or into a well. The basic flow in the pathway is that of the produced or injected fluids. This may include flow of well fluids which enter or are introduced into the annulus or spaces between the concentric tubes in a wellhead or the tubular bodies which are part of the wellhead system.

Vertical connection of fluid pathways is the most basic, typical approach. Its main advantage is that it relates well to the sequential stack up of the system components. Also, it agrees with the installation motion, which is a form of vertical displacement. However, the vertical stacking of the wellhead system may have disadvantages, such as it may require rotational orientation of the system components around the well axis if the path is not entirely between concentric numbers and may require refined alignment tuning. Horizontal, radial connection of pathways requires no such rotational orientation to the well axis but fine alignment may still be needed.

Subsea Christmas trees and subsea completion because of environmental issues and overall economics need to be retrieved leaving the tubing hanger undisturbed. The tubing hanger needs to be landed in and locked to the wellhead independent to the landing and locking of the tree.

The present invention is related to a device which has separate lock and seal retract functions for a Christmas tree and for a tubing hanger so that when deploying or retrieving a Christmas tree, the seals must be retracted without unlocking the tubing hanger from the well.

A conventional tree installation requires the tree to be pulled prior to pulling the completion. A side valve tree requires the completion be pulled prior to pulling the tree.

The present invention relates to a subsea tree tubing hanger system which has the capability to deploy or retrieve a subsea tree subsea tubing hanger or subsea completion without regard to the sequence of the retrieval or deployment.

BRIEF SUMMARY OF THE INVENTION

This invention relates to an improved subsea wellhead in which the tree can be removed while leaving the tubing hanger in place, or alternatively the tubing hanger can be removed while leaving the tree in place. The structure includes a wellhead housing having a wellhead internal bore and which is adapted to be supported on a seabed. A tree having an internal tree bore, is disposed above the wellhead housing and connection means, including a fine alignment key, are provided for connecting the tree to the wellhead in alignment therewith for establishing communication between the tree internal bore and the wellhead bore. A tubing hanger is landed in the tree internal bore with a production tubing string and an annular tubing string extending downwardly therefrom. In this invention, the tree has a plurality of ports such as a radial production port for communication with the production bore and with an external production line, an annular access port for communication with an annular access line, and possibly an additional port for hydraulic connection to said internal bore or for chemical injection into the tree internal bore. In operative association with the tubing hanger are slidably movable gates which are capable of opening and closing one or more of the ports, simultaneously, and obviate the need for annular seals. The gates can also be manipulated to cause outer seals in the tubing hanger to retract so that the tree can be removed from the wellhead without damaging the outer seals. Accordingly, the tree and completion can be run and/or retrieved independently. A tubing hanger and tree running tool is adapted for use with the invention. The invention includes a process, using the slidably moveable gates for removing a tree, a production tree, or a tubing hanger from a subsea wellhead and also includes a method for retrieving a tree from a wellhead without having to remove the production tubing.

BRIEF DESCRIPTION OF THE DRAWINGS

These and other objects of the prevent invention are set forth and explained with reference to the drawings wherein:

FIG. 3(*b*) is a view similar to FIG. 3(*a*) but showing the tubing hanger rotated 90 degrees about is longitutional axis;

FIG. 3(*c*) and FIG. 3(*d*) are enlarged detailed fragments of the gate component of the invention as used in the tubing hanger for retracting or extending outer seals of ports provided in the hanger when the ports are open as in FIG. 3(*d*) and closed as in FIG. 3(*c*);

FIG. 3(*e*) is a transverse cross section view taken through the tubing hanger port shown in FIG. 3(*c*) and 3(*d*) showing the relationship of the inner and outer seals for the port with respect to the gate;

FIG. 3(*f*) is a top plan view of the seal retainer as shown in FIG. 3(*c*);

FIG. 3(*g*) is a side view of the seal retainer;

FIG. 3(*h*) is another side view of the seal retainer;

FIG. 7(*b*) is a similar schematic section view of the running tool of FIG. 7(*a*) wherein the tool has been rotated 90 degrees about its longitudinal axis;

DETAILED DESCRIPTION

Figure 1:
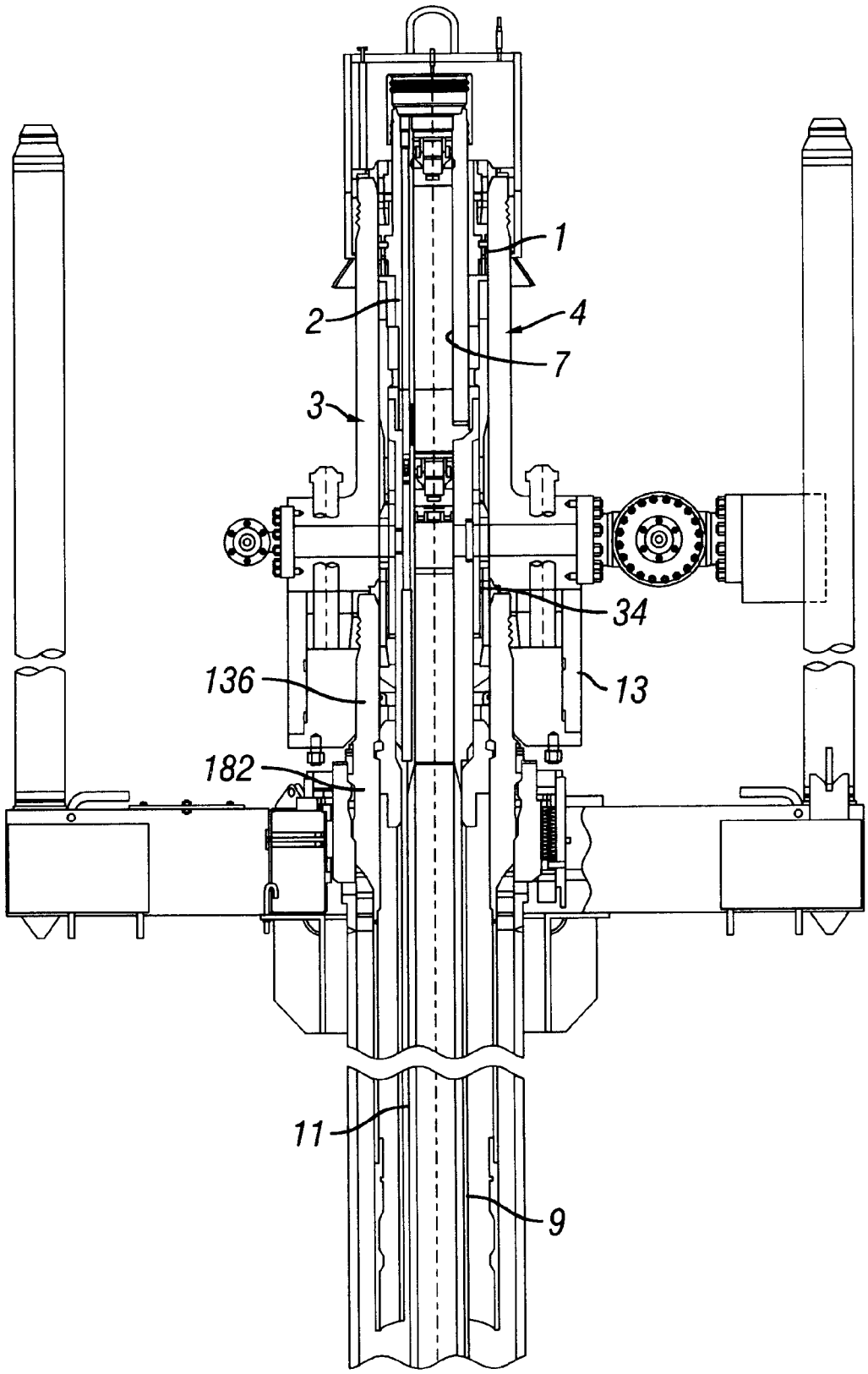
FIG. 1 shows a locked and landed tree on a wellhead with a tubing hanger landed in the tree and a tree cap installed in the tree.

Referring more particularly to the drawings, there is shown in vertical section view in FIG. 1 a subsea wellhead 136 on which a typical tree 1 is mounted by means of a connector 13 with the central internal bore of the tree in coaxial alignment with the control internal bore of the wellhead. A casing hanger 6 is landed in the wellhead bore and a casing string 9 is suspended therefrom. A tubing hanger 4 is landed in the bore of the tree 1 with a tubing string 11 suspended therefrom inside the casing string 9. A tree cap 2 is provided the tree 1 and mounted thereon to extend longitutionally within the central bore of the tree 1.

Figure 2:
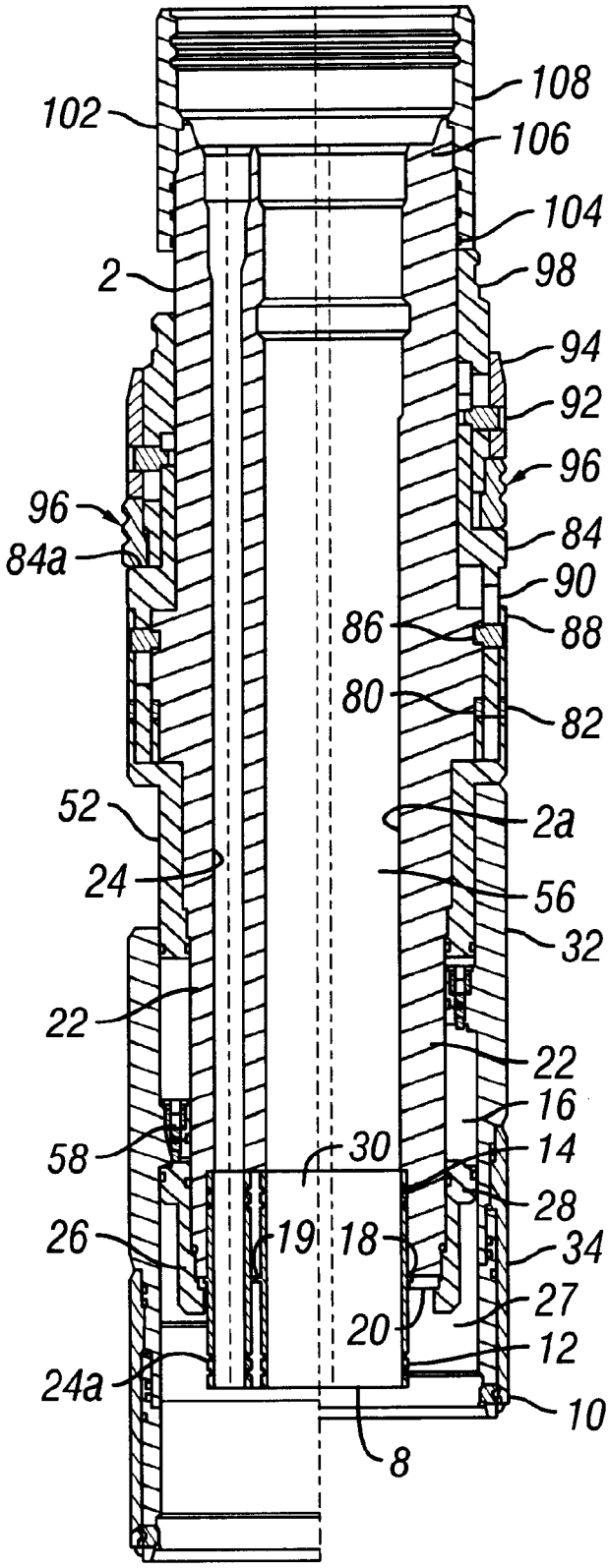
FIG. 2 is a longitutional cross section which shows the invention installed in an internal tree cap and the gate piston of the invention shown in two different positions and wherein the right half of the figure represents the left half of the tree cap rotated 180 degrees about its longitutional axis.
Figure 3A:
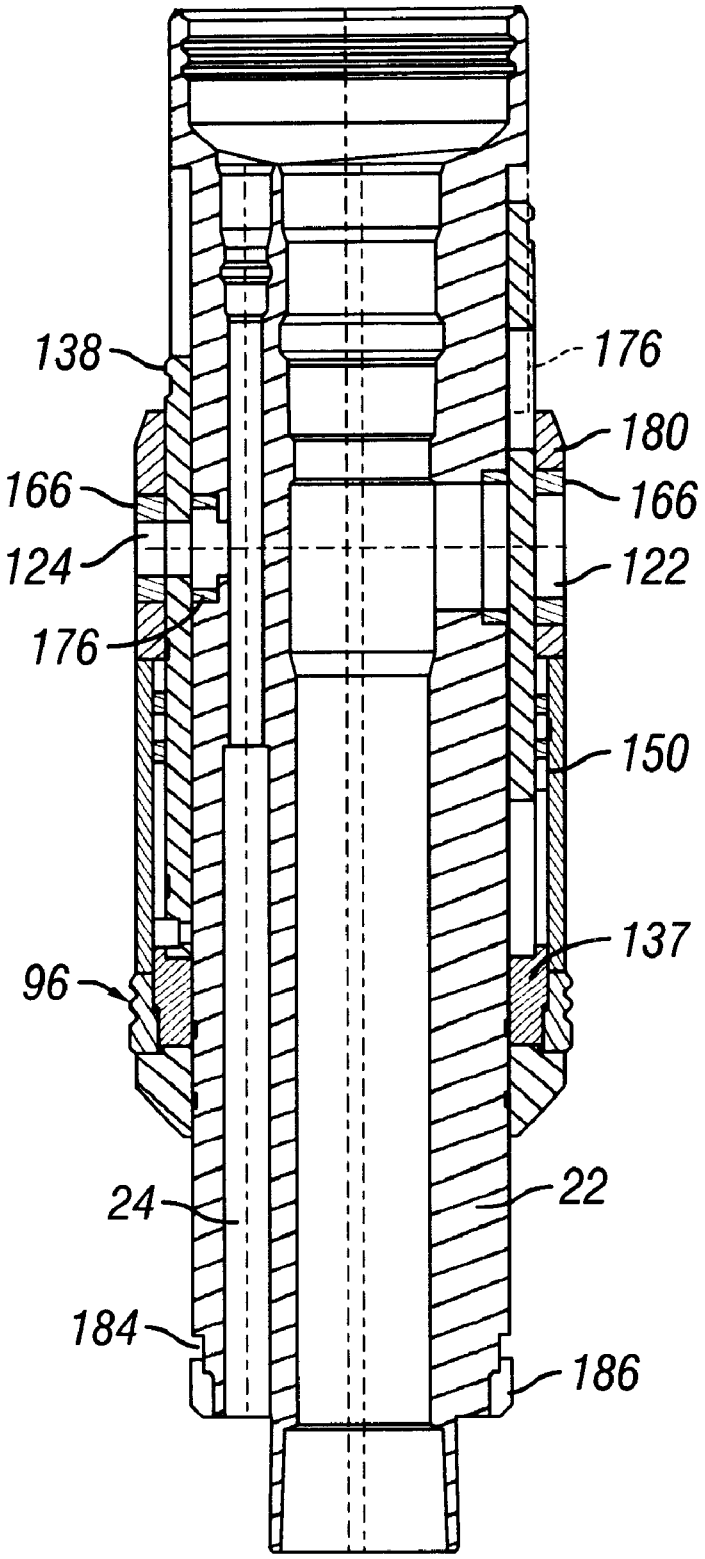
FIG. 3(*a*) shows a tubing hanger layout using the invention and wherein the tubing hanger is shown in longitutional cross section.
Figure 3B:
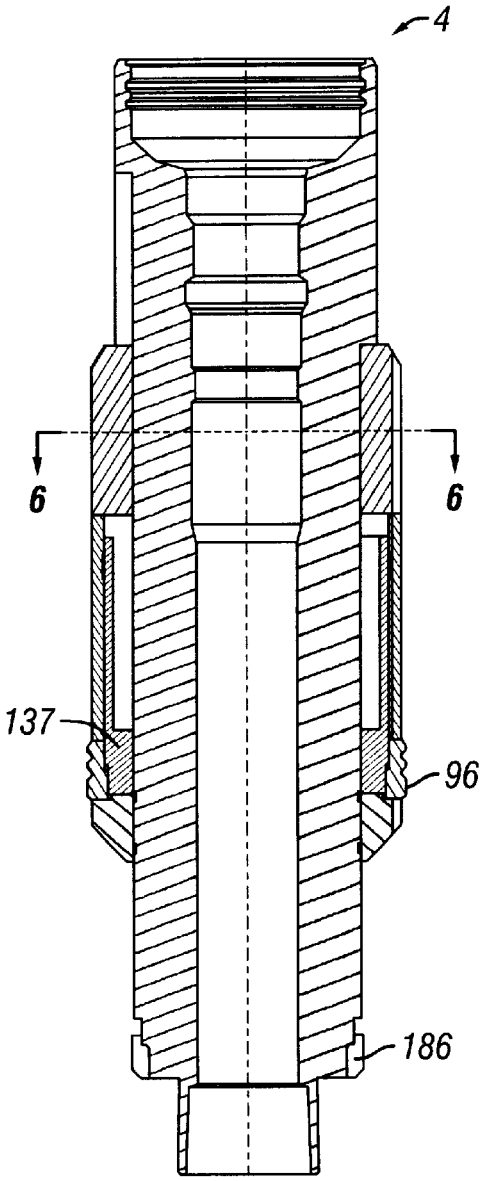

In FIG. 2 it is shown that the tree cap 2 is provided with an annulus tube 24 extending vertically therefrom. A first stab 8 is fixed at the lower end of the tree cap and extends therefrom. The stab 8 is provided with first and second annular circumferential seals 10 and 12 near the lower end thereof and third and fourth circumferential seals 14 and 16 near the upper end thereof. The seals 10 and 12 can be metal-to metal seals or resilient seals wherever the third and fourth seals 14 and 18 are preferably O-rings of elastomeric material. The first stab 8 serves as a fine alignment key for aligning the central internal bore of the tree cap 2 with the production bore of the tubing hanger 4.

For holding the first stab 8 in place, the tree cap 2 is provided with a mechanism including a transferential first lip 18 on stab 8 which engages the topside of a transverse circular plate member 20 designed to hold the first stab 8 to pressure containing member 22. The tree cap 2 is further provided with an annulus stab 24*a* for holding the annulus stab 24*a* to the annulus tube 24 and to the pressure-containing member 42.

The circular plate 20 is provided with two holes, one of which is sized to accommodate the first stab 8 threadthrough and the other of which is sized to accommodate the second stab 24 threadthrough. The first stab 8 with first lip 18 and annulus stab 24 with a lip 19 engage by their lips with the topside of the circular plate 20. An enclosing cylinder sealing member 26 having internal threads is threadedly connected to the bottom end of the tree cap 2. The sealing member 26 is also provided with an inwardly projecting end flange 27 at the lower end which engages the underside of the plate 20 for clamping the plate 20 against the bottom end of the member 22 for holding both stabs in place. At the other end, the sealing member 26 is provided with an inner diameter seal 30 which seals against the body of the pressure-containing member 22. It is also provided with an outer diameter circumferential seal 28 which seals against the inner wall of a tubular lock piston 32.

Another threaded cylindrical sealing member 52 is threadably connected about the body of the pressure-containing member in vertical spaced relation to the first sealing member 26. The sealing member 52 is provided with an inner diameter seal 56 for sealing with the outer surface of the pressure containing member 22.

Also as seen in FIG. 2, the upper portion of the tree cap (2) is shown as it is designed to seal off stalk 3. In particular, main body 22 is sealed with a first upper metal to metal annular seal 80 and a second annular metal to metal seal 82. Metal to metal seals are used because of corrosion due to the fluids used in the tree.

A seal actuator 84 is sleeved about the tree cap in position between the second metal to metal seal 82 and the first metal to metal seal 80. A first pin 86 goes through the seal actuator acting as a stop for a first protector sleeve 88 disposed in sleeved relation to the actuator 84.

The outer diameter of the first outer metal to meal seal 80 is recessed, having a smaller diameter than the first protector sleeve 88 to protect the metal to metal seal 80 during use when the tree cap 2 is retrieved or deployed.

Solid contact exists between first protector sleeve 88, first pin 86, and main body 22, as shown in the drawing. Seal actuator 84 contains a plurality of slots, herein represented by the slot 90 in the walls of seal actuator 84.

The slot 90 in the actuator allows a plurality of pins such as first pin 86 to bridge between main body 22 and first protector sleeve 88 without impeding the axial motion of the seal actuator 84.

A second pin 92 which is circular in transverse cross section and threaded on one end, is threaded to actuator 84 and also bridges between actuator 84 and a second protector sleeve 94.

A split-locking ring 96 engages a radical shoulder 84*a* of seal actuator 84. This split locking ring, in the preferred embodiment has a split lock ring actuator 98 mounted directly above. A handling ring 102 provides the interface to the tubing hanger running tool from the tree cap. The handling ring 102 is threaded and sealed against main body 22 using a plurality of seals, a seventh seal 104, an eighth seal 106 and a ninth seal 108. By means of hydraulic pressure delivered from a passage in a running tool inserted in the tree cap, the actuator 98 may be slidably moved to expand or retract the locking ring 96 to lock or unlock from the wellhead.

Figure 5:
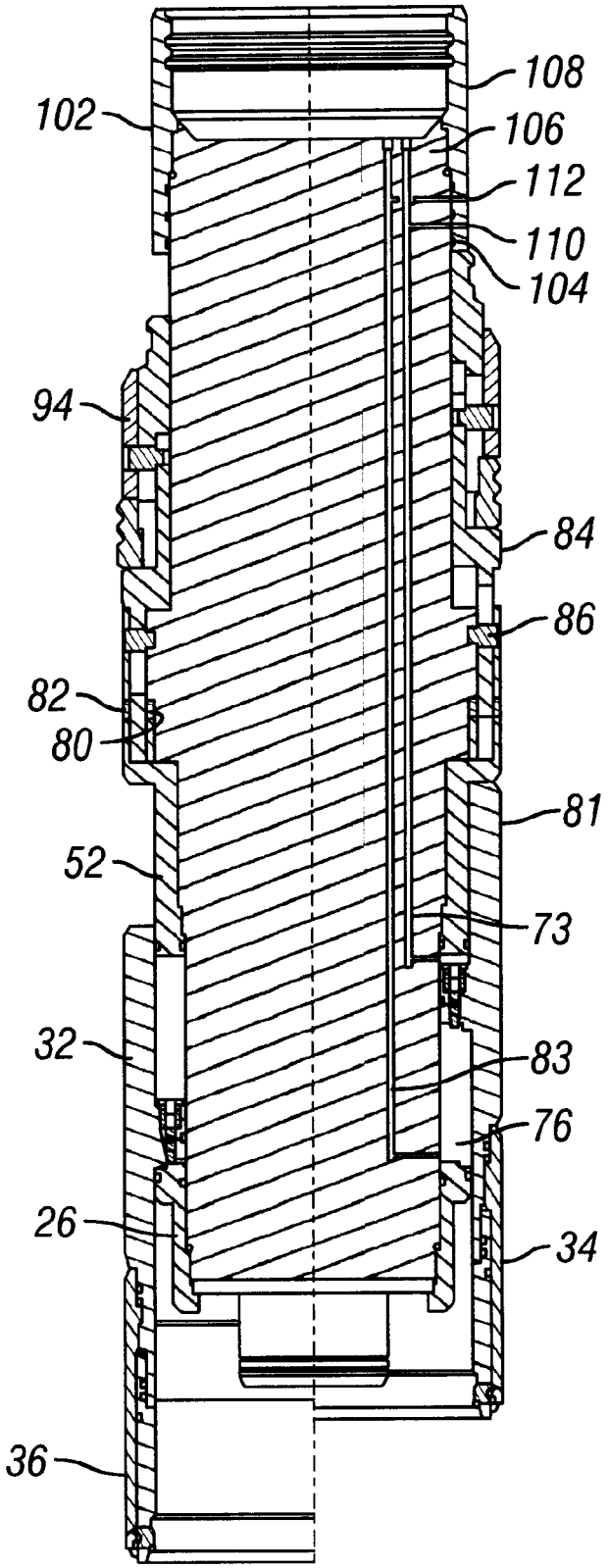
FIG. 5 is a longitutional cross section view showing the tree cap of FIG. 2 and the running tool interface therewith.

Two ports are also located in the handling ring 102 of the tree cap as shown in FIG. 5. Third port 110 and fourth port 112 can be the chemical penetration ports or an annular access port. These ports are disposed between additional seals, shown in FIG. 5 as seals 104, 106 and 108, respectively, and communicate with passages in the member 22.

Figure 6:
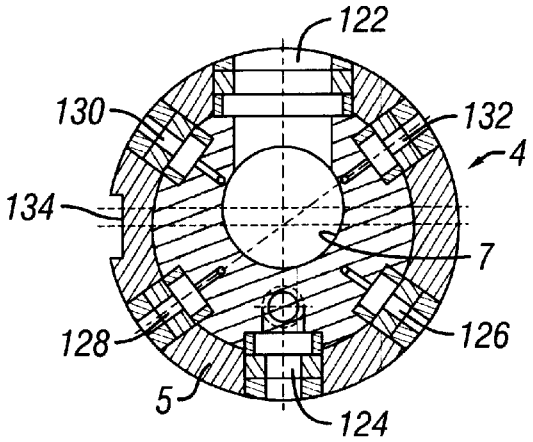
FIG. 6 is a transverse cross section view as taken along the section line 6—6 in FIG. 3*b;*
Figure 3C:
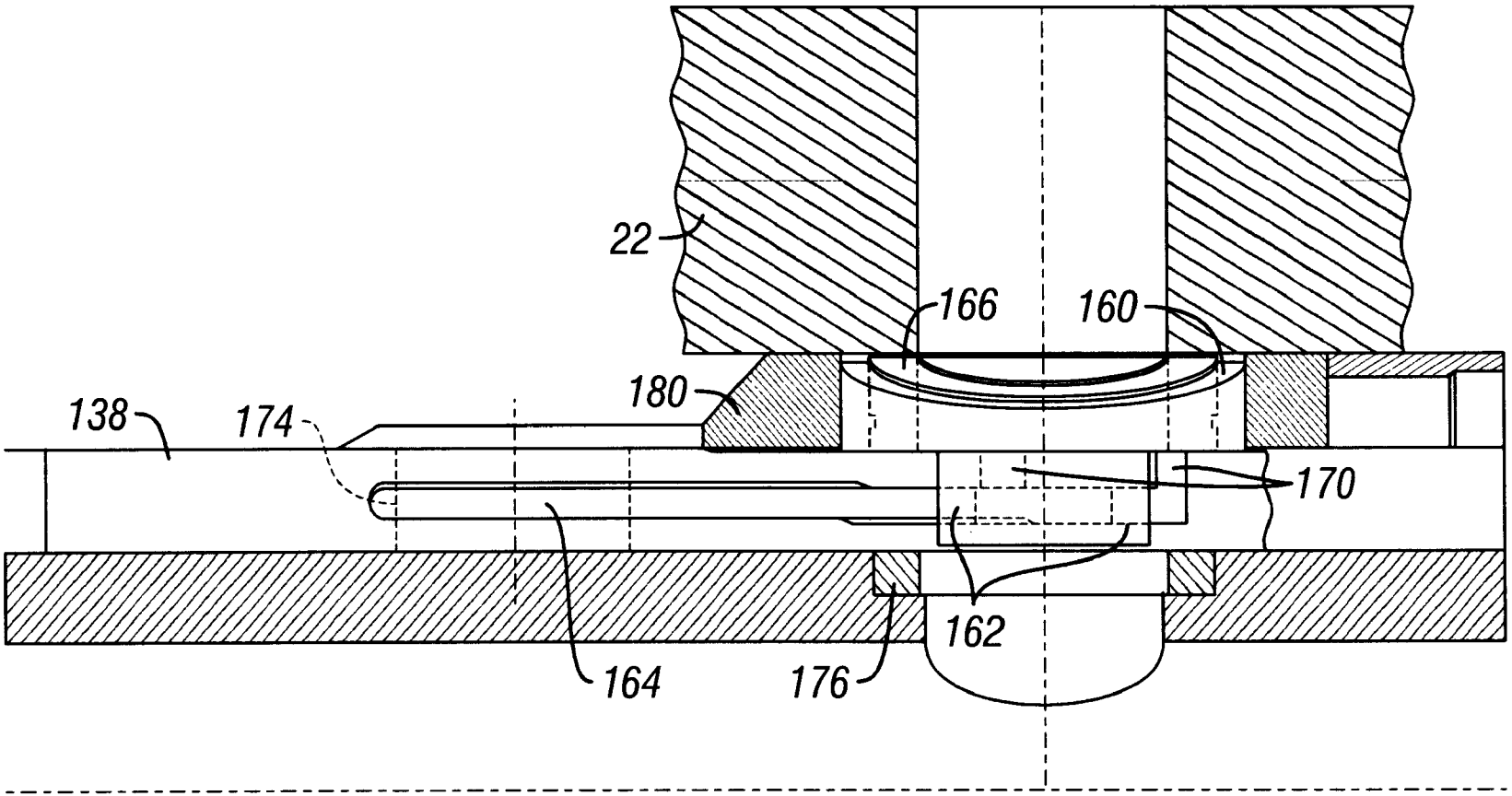
Figure 3D:
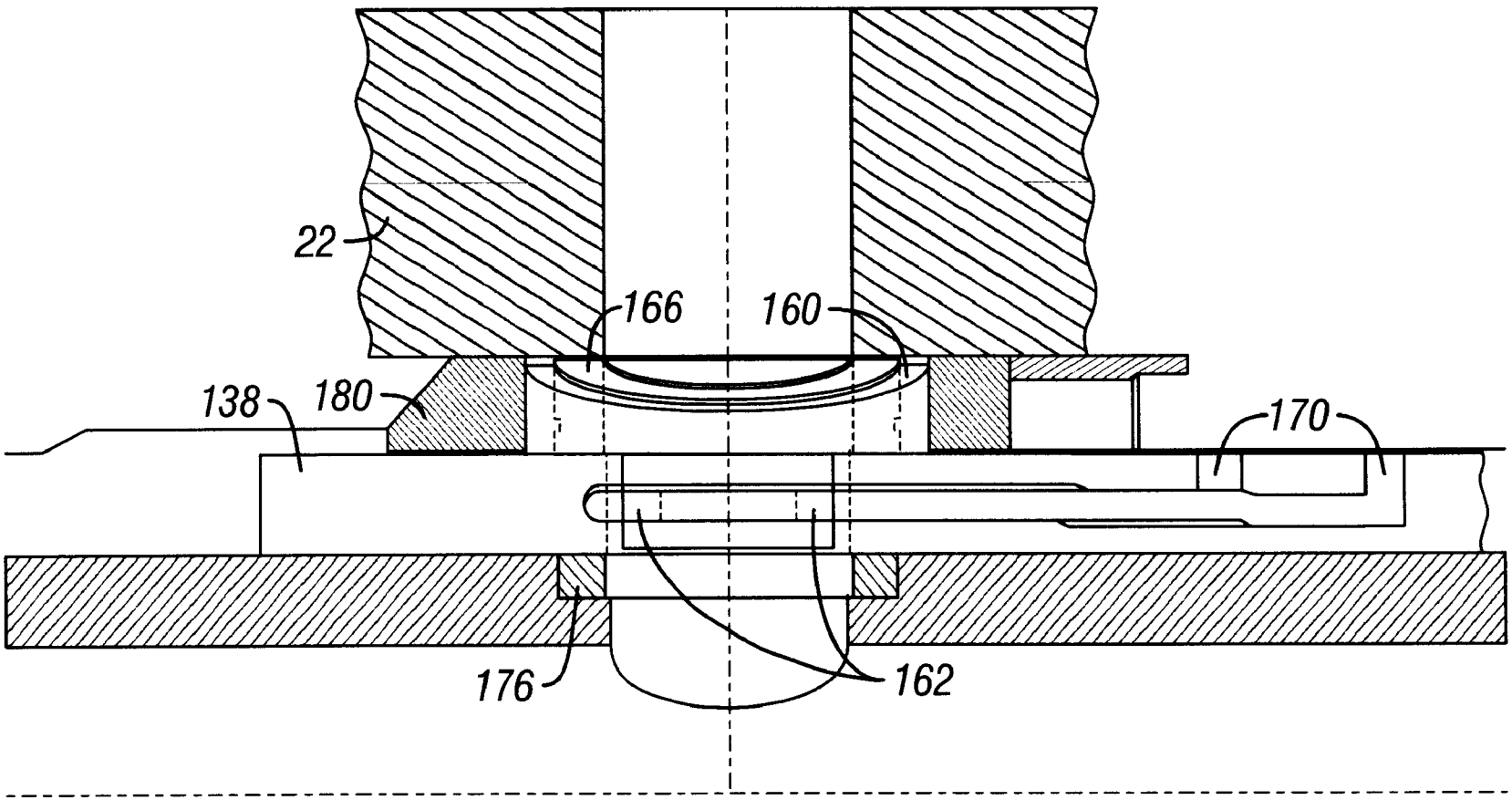
Figure 3E:
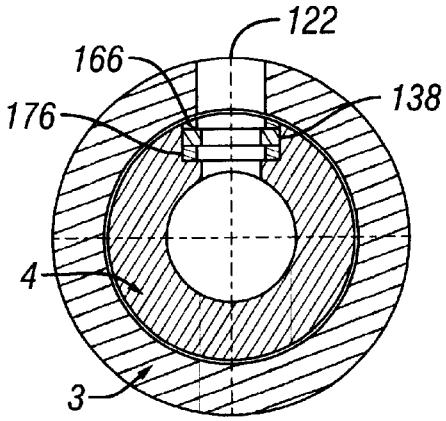
Figure 3F:
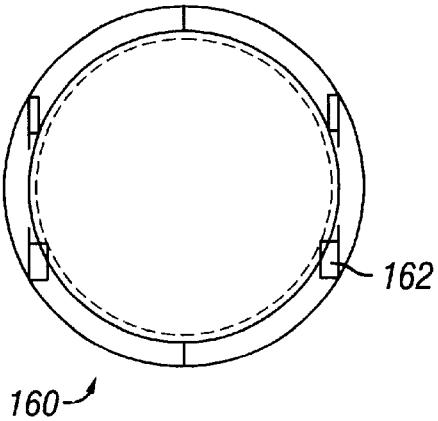
Figure 3G:
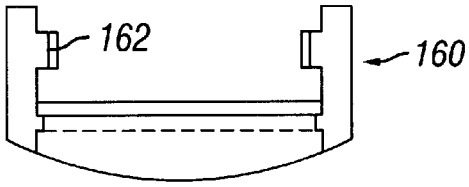
Figure 3H:
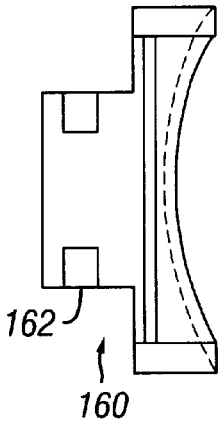

It is also to be seen in FIG. 2 that a lock piston 32, cylindrical and tubular in configuration, is slidably mounted in sleeved relationship about the sealing member 52 and extends beyond the fee end of the stabs 8 and 24. The lower position of the lock piston 32 is provided with a reduced external diameter. A cylindrical tubular gate piston 34 is mounted in sleeved relation about the reduced diameter portion of the lock piston 32 and is independently moveable thereon. The gate piston 34, when positioned with one end in abutting relation with the large diameter portion of the lock piston 32, extends beyond the lower end of the lock piston and a gate dog 36 is mounted in a recess in the internal cylindrical surface of the gate piston closely adjacent to the lower end. As an example, the gate dog 36 is adapted to engage in a recess provided in the surface of a gate member located in the tubing hanger 4 therebelow. Additionally, the gate dog may clamp onto the gate. One such gate dog will be provided for each gate member in the tubing hanger. In the invention, as shown in FIG. 3, the tree cap member 2 is provided with a production port 122 in diametrically approach relation to a radial port 124 provided in the annulus tube 24. The ports 122 and 124, also shown in FIG. 6, are selectively opened and closed by the movement of a tubular gate member 138 which is mounted for sliding movement in reciprocal directions on the pressure containing member 22. In this respect, gate member 138 is provided with a port 122 diametrically opposed to port 124. Accordingly, when the gate 138 is positioned with the port 122 in registry with the production port 122, the production port is open. In the right half of FIG. 3, the gate 138 is shown in a position which closes the production port 122. In the left half of FIG. 3, gate 138 is shown in a position which opens the annulus tube port 124. It is to be noted that each of the ports 122 and 124 is provided with an annular inner seal 176 which seats in a conforming recess in the outer wall of the tree cap in coaxial relation with the axis of the port opening and establishes a fluid-tight seal between the tree cap and the gate 138. It will also be seen that each of ports 122 and 124 is provided with an annular outer seal 166 which is received in an circular opening provided in a seal sleeve 180. As seen in FIG. 3, the gate 138 is mounted for sliding movement between the seal sleeve 180 and the tree cap.

It is to be appreciated that the present invention is designed to prevent scarring of the metal to metal seals while retrieving a tubing hanger independently of a tree, or retrieving a tree independently of a tubing hanger.

In the section view shown in FIG. 6, it will be seen that in addition to the ports 122 and 124, the tubing hanger 4 may be provided with a plurality of other radial ports, such as a first hydraulic penetration port 126, second hydraulic penetration port 128, third hydraulic penetration port 130, and fourth hydraulic penetration port 132. A fine alignment key slot 134 is also provided on the exterior surface of the tubing hanger.

As shown in FIGS. 3(*c*) and 3(*d*), each port is provided with inner and outer seals 176 and 166 respectively, and a seal retainer 160. In FIG. 3(*a*) which is an enlarged detailed illustration of the gate 138 in the closed position, it is to be noted that each port, such as production port 122 or the hydraulic penetration ports 126, 128, 130, 132, includes as shown in FIGS. 3(*c*), 3(*d*), and 3(*e*), a seal retainer 160, which is a split part having two equal halves. Each half has cam ears 162 that engage linear cam slots 164 in the gate. The gate 138 holds the outer seal retainer 160 and as a result, outer seal 166 is kept in collapsed position such that the seal clears the bore and the stalk protects the seals from damage. Clearance 168 is maintained. The outer seal 166 drops through assembly slots 170 for ease of assembly of the system. Assembly slots 170 permit the gate 138 to move downward and engage the cam ears. The cam ears follow the cam slot ramps and the retainer extends. The use of at least two cam ears is needed since the trailing cam ear is longer than the leading cam ear. Cam slots very in depth. For each tubing hanger a plurality of seats, cams, retainers are contemplated.

When the gate 138 moves in the downward direction shown in FIG. 3(*a*), it pushes against cam ears 162 on seal retainer 160 creating a force in a perpendicular direction against the seal retainer 160. The seal retainer 160 expands, pushing against outer seals 166 and moving the seals out of the way should the tubing hanger need to be retrieved independent of the tree. These seals are typically metal to metals seals and can be damaged when a tree is pulled if these seals are not retracted.

In addition to creating retraction of the seals, the seal retainer 160 can act in a manner such that the opposite extension of the seals can occur when the tubing hanger is redeployed and the gate 138 is manipulated in an upwardly direction by a tubing hanger running tool.

The gate 138 also contains a port 174 shown in dashed lines which when in the fully extended downward position to the right in FIG. 3(*c*), permits fluid communication with a select one of variety of ports which enter the tubing hanger and the fluidly connected subsea tree. Some of these ports are production ports, some are annular access ports, some can be used to inject chemicals into the well production bore and some can be used to insert hydraulic means into the well, or perhaps other testing equipment.

It will also be seen that the gate 138 is provided with assembly slots 170 in the face 138*a* of the gate 138. The outer seal 166 drops through assembly slots 170 for assembly of the system. Assembly slots 170 permit the gate 138 to move downward and engage the cam ears. The use of at least two cam ears is needed since the trailing cam ear is longer than the leading cam ear. For each tubing hanger a plurality of seals, cams and retainers are contemplated.

Figure 4:
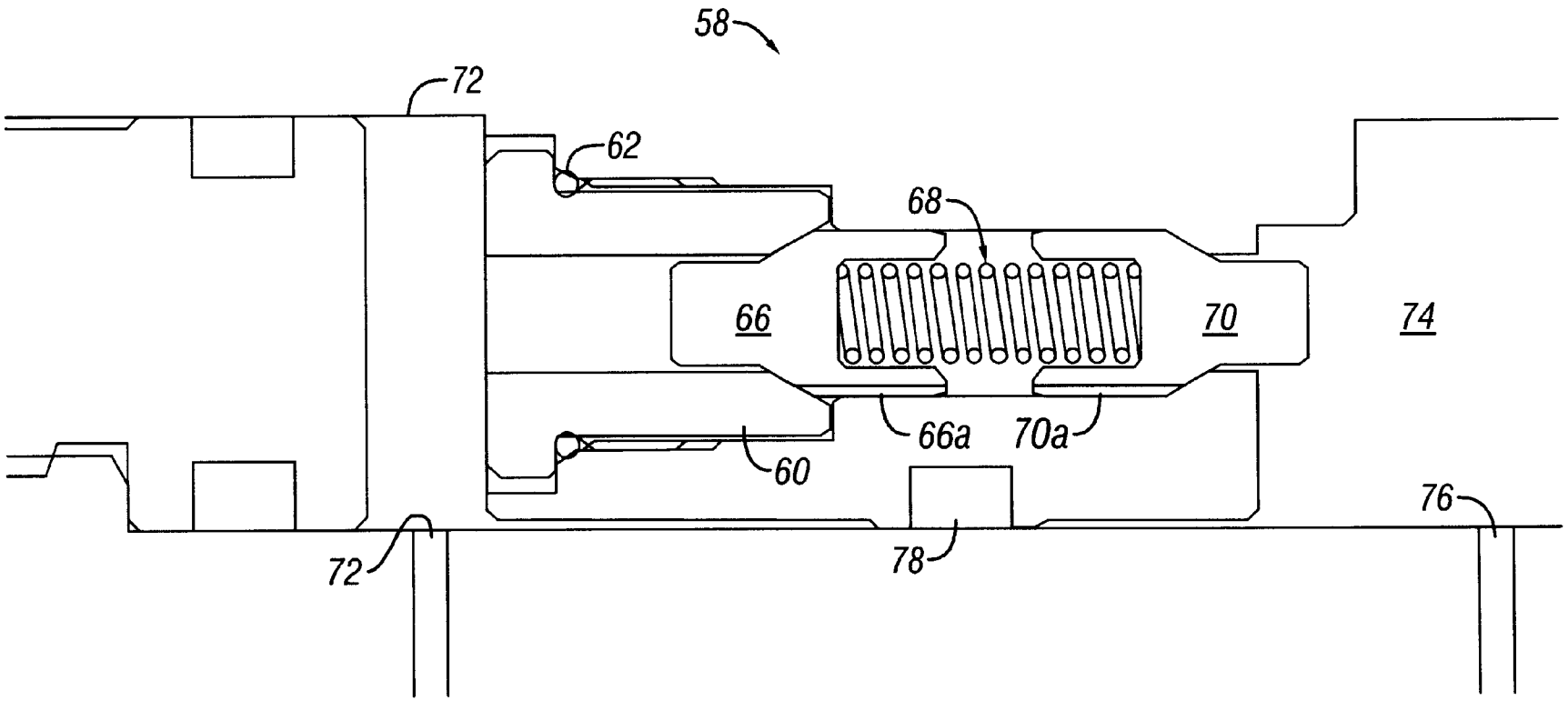
FIG. 4 is an enlarged schematic view of the relief valve used in the invention.

FIG. 4 shows a detail of the relief valve 58 which is attached to the lock piston 32 which is capable of opening and closing the valve 58. Relief valve 58, shown in operative relation with the lock piston 32 in FIG. 2, consists of a seat 60 on which an SAE straight threaded and O-ring connection 62 is attached. Seat 60 is sealed against a first poppet 66. First poppet 66 engages one end of a coiled spring 68 which pushes against the first poppet and its other end pushes against the second poppet 70 thereby creating an unidirectional hydraulic seal. Hydraulic pressure can be exerted on either the first or second poppet, depending on the direction the valve needs to move. Opening 72 in the relief valve is for receiving hydraulic fluid from a first port 73 which drives the relief valve 58. At the end of the lock piston stroke, the relief valve 58 opens, the second poppet 70 moves axially to contact the upper face of the first threaded sealing member 26 thereby compressing spring 68 and allowing fluid to pass through external grooves 66*a* and in 70*a* poppets 66 and 70, respectively, and enter the annular volume 74 below the poppet 70. A second port 76 connecting with the tree running tool is connected to the subsea completion using typically, an umbilical connecting to the surface. This connection can be used as a stroke indicator, advising an operator at the surface that the gate piston has completed its stroke and the tubing hanger is ready for removal.

The present invention permits a tubing hanger to be independently removed from a tree by first using a tubing hanger running tool to disengage the tree cap from the tubing hanger. The tree cap is then retrieved to the surface. Next, the tubing hanger running tool is used to manipulate gates 138 to cause the seal retainer to retract outer seals 166 and to create a secure inner seal. Next, the tubing hanger running tool is used to unlock tubing hanger from wellhead. Finally, the tubing hanger is retrieved.

A tubing hanger can be redeployed using the gates. A tubing hanger running tool is used to manipulate the gates and extend the outer seals as well as to lock the tubing hanger to the wellhead. As the gates slide back into place, from the downward position to the upward position, the gate port realigns with the ports of the tubing hanger, reestablishing communication between the gate port and the ports of the tubing hanger. The tubing hanger running tool is then disconnected and retrieved. Next, a tree running tool is used to reconnect the tree cap to the tree. The tree running tool is used to manipulate the gates and to lock the tree cap to tree. The tree running tool is then retrieved.

The present invention is also designed to enable the removal of the subsea tree while leaving a tubing hanger in place. To remove a tree, the following process is used:

A tree running tool is used to manipulate the gates and retract the outer seals and cause the inner seal to engage securely;

While the tubing hanger is not unlocked or otherwise disengaged from the wellhead, a tree cap running tool is used to disengage the tree cap from tubing hanger;

The tree running tool is then used to manipulate the tree and unlock it from the wellhead;

The tree and tree cap are then retrieved as a unit.

To redeploy a tree, a reverse process is used. In the preferred embodiment, the tree cap is re-installed on the tree at the surface. The tree and tree cap combination are then redeployed by a tree running and tool down to the wellhead.

The tree running tool engages the tree cap to the tubing hanger by manipulating the gates, and the tree is locked and landed on to the wellhead with the tree running tool. The tree running tool then manipulates the gates to extend the outer seal and secure the tree on the wellhead.

Figure 8:
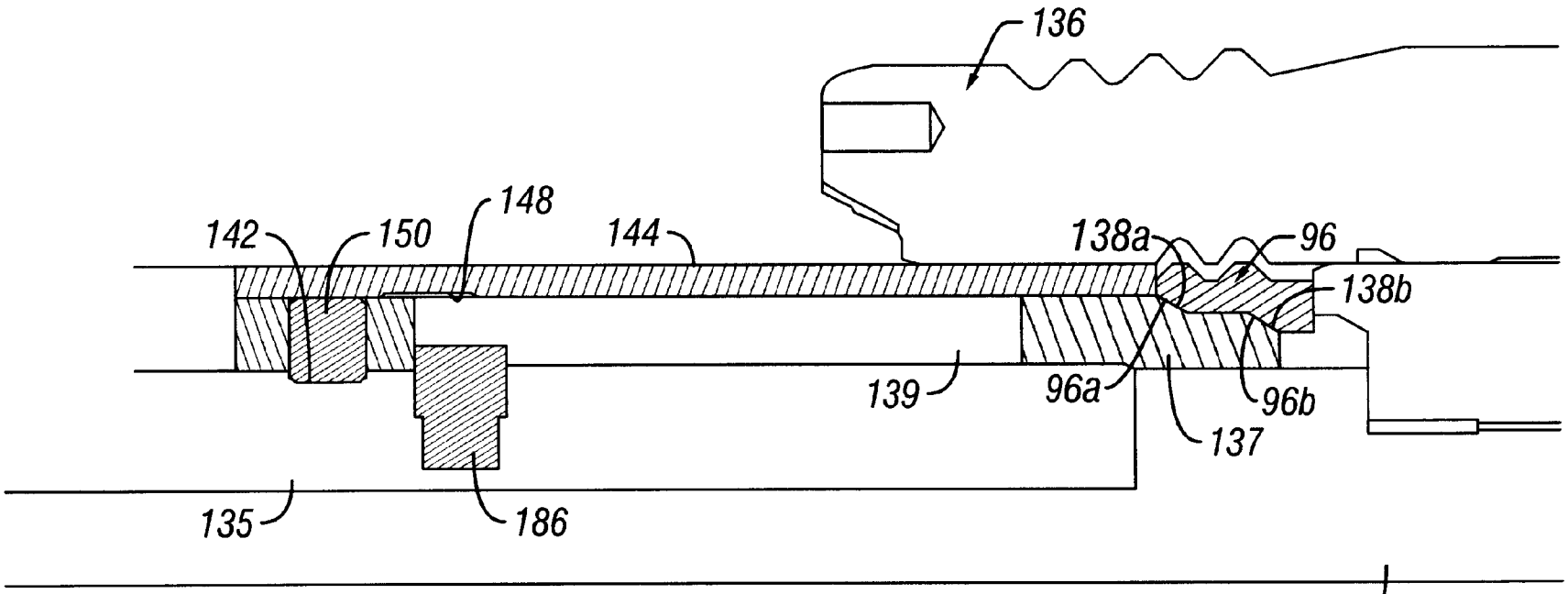
FIG. 8 is a fragmentary view partly in section showing a gate component of the invention which can be activated to unlock the tubing hanger from the wellhead; the gate being in closed position with a lost motion dog trapped in engaged position therewith.
Figure 9:
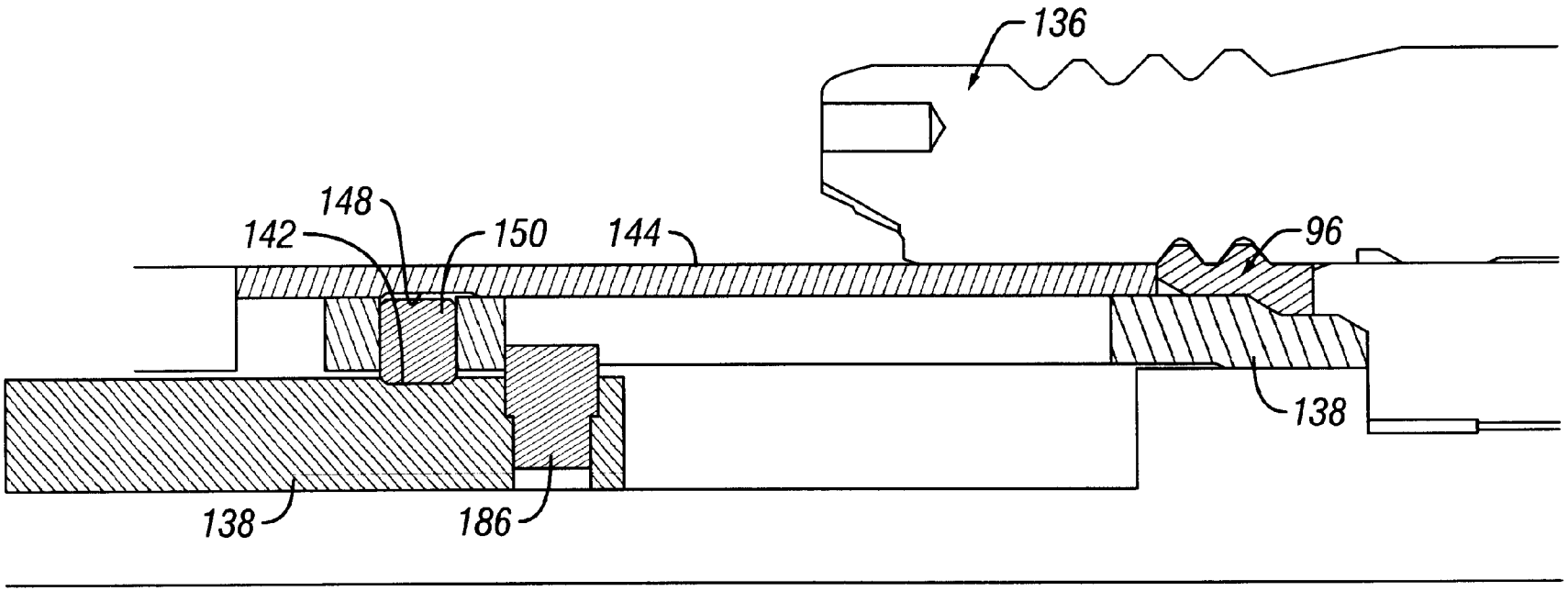
FIG. 9 is a view similar to FIG. 8 but showing release of the lost motion dog and expansion of the split lock ring which locks the tubing hanger to the wellhead.
Figure 10:
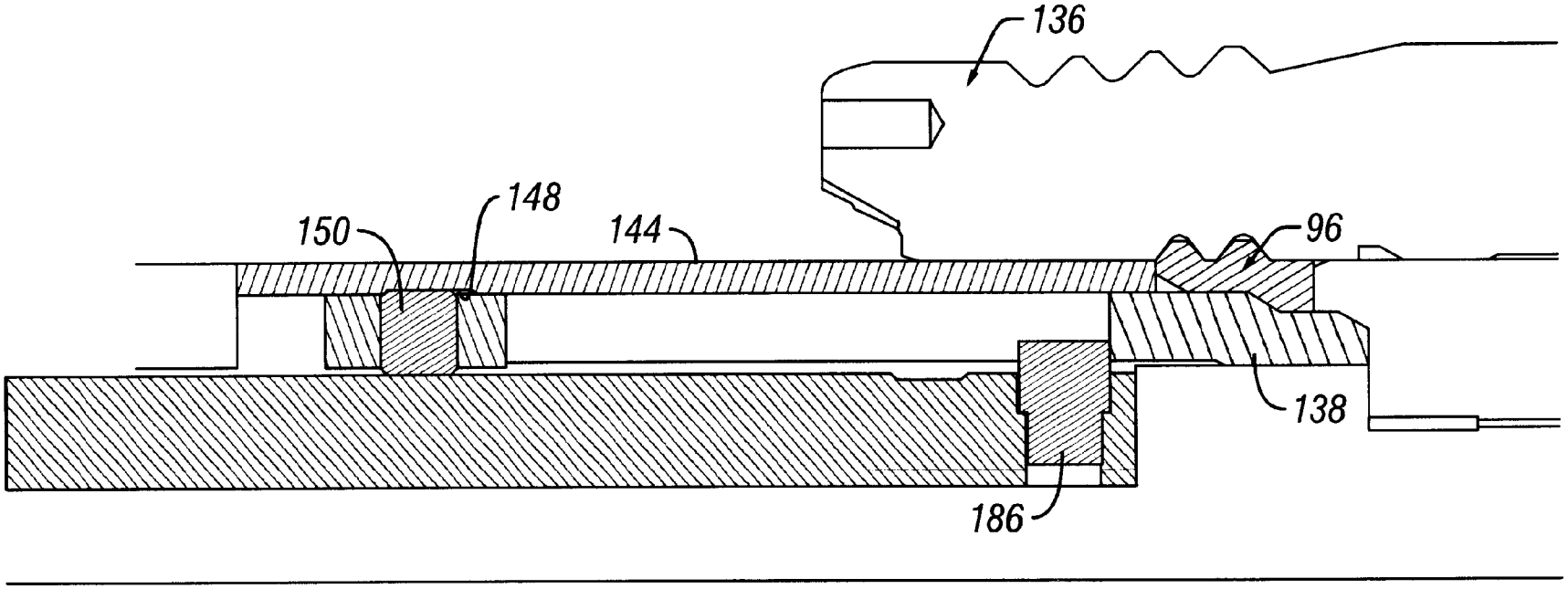
FIG. 10 is a view similar to FIG. 9 but showing the gate in open position with the lost motion dog disengaged form the gate.
Figure 12:
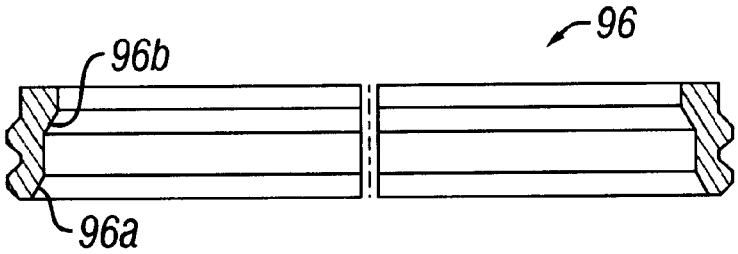
FIG. 12 is a section view of the split-locking ring of FIG. 11 as taken along the section line 12—12.
Figure 11:
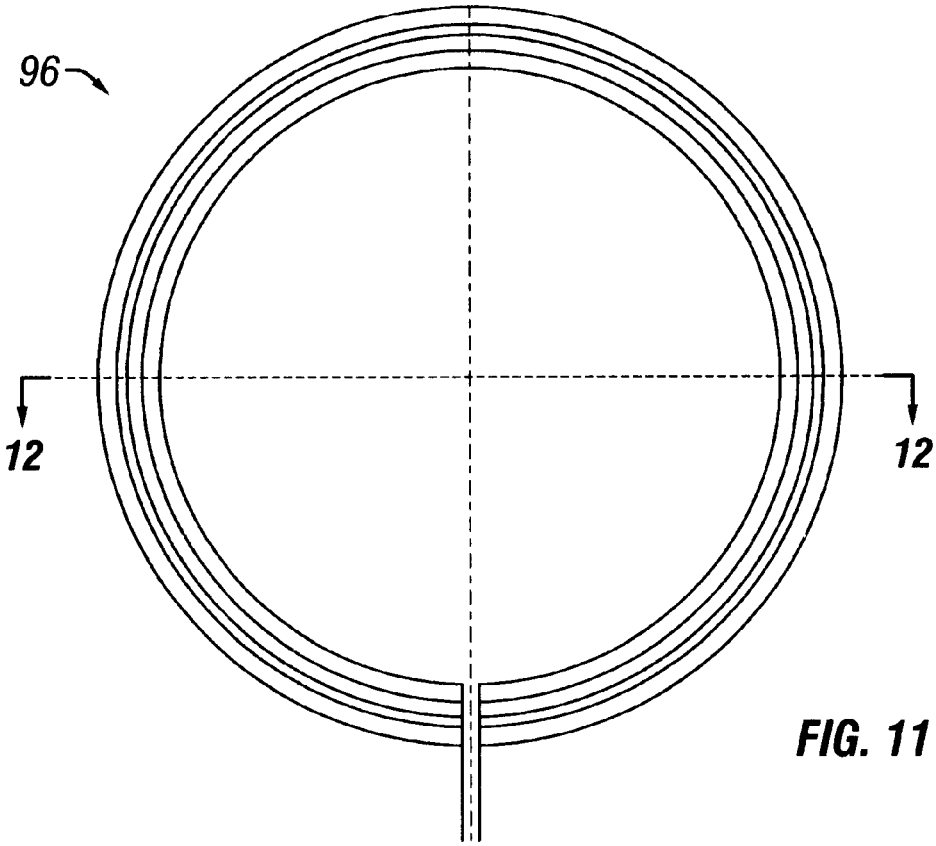
FIG. 11 is a plain view of the split locking ring shown in FIGS. 8, 9 and 10.

In the invention, as shown in FIG. 8, a lost motion dog 150 is when trapped between the drive gate 135 and the bore wall of the spacer member 144 such that it can transfer axial load between the gate piston and the lock ring support, where frusto-conical shoulders 138*a* and 138*b* engage conforming shoulders 96*a* and 96*b* of the split lock ring 96 shown in FIG. 8 in collapsed condition. As shown in FIG. 9, the lost motion dog 150, as the gate piston and gate move down, is freed to disengage from the gate by moving radially outward into the relief groove 148 in the spacer 144 as shown in FIG. 10 and the lock ring support 137 travels far enough to expand the split lock ring 96 which anchors the tubing hanger 4 to the wellhead 136.

Once the gate travels independently of the lost motion dog 150, the lock ring support can not move further.

After the split rock ring is expanded, axial travel in either direction is limited to the length of the slot in which the pin 186 is installed. The lock ring support, and therefore the split lock ring, is not disturbed, as shown in FIG. 10, where the gate is shown moved downward to its open position. It is to be noted that the above description of the interaction of the lost motion dog and split lock ring applies to the split lock rings used for the tree cap and tubing hanger. Upward travel of the pin to the original position is required to collapse the split lock ring. This occurs when the pin reaches the slot's extreme upward face end and pulls the lock ring support to its upward most position. This entire process is completely reversible within the scope of the present invention.

Figure 7A:
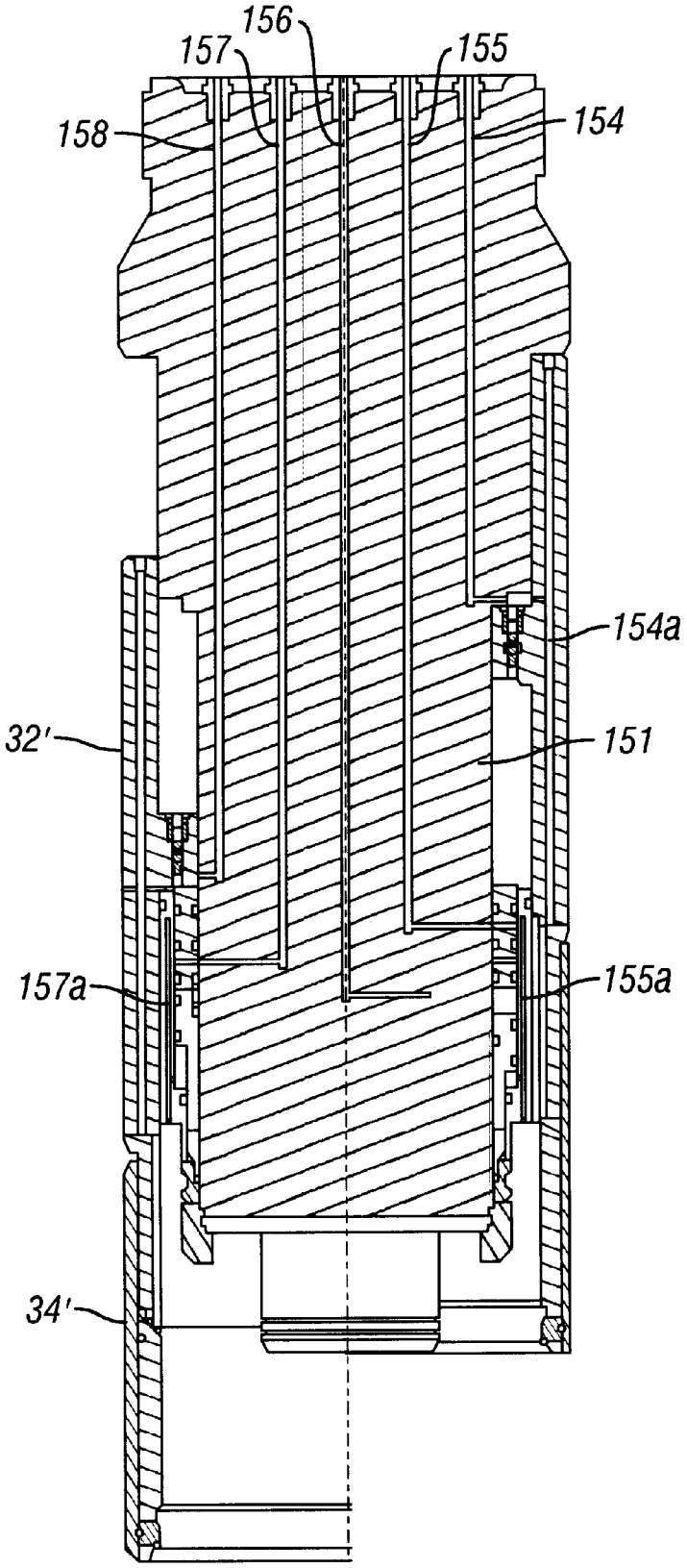
FIG. 7(*a*) is a schematic longitutional section view of a running tool which can be used with the invention installed in a tree cap and a tubing hanger, and wherein the left and right halves of the FIG show the gate piston and lock piston of the tubing hanger in different positions.
Figure 7B:
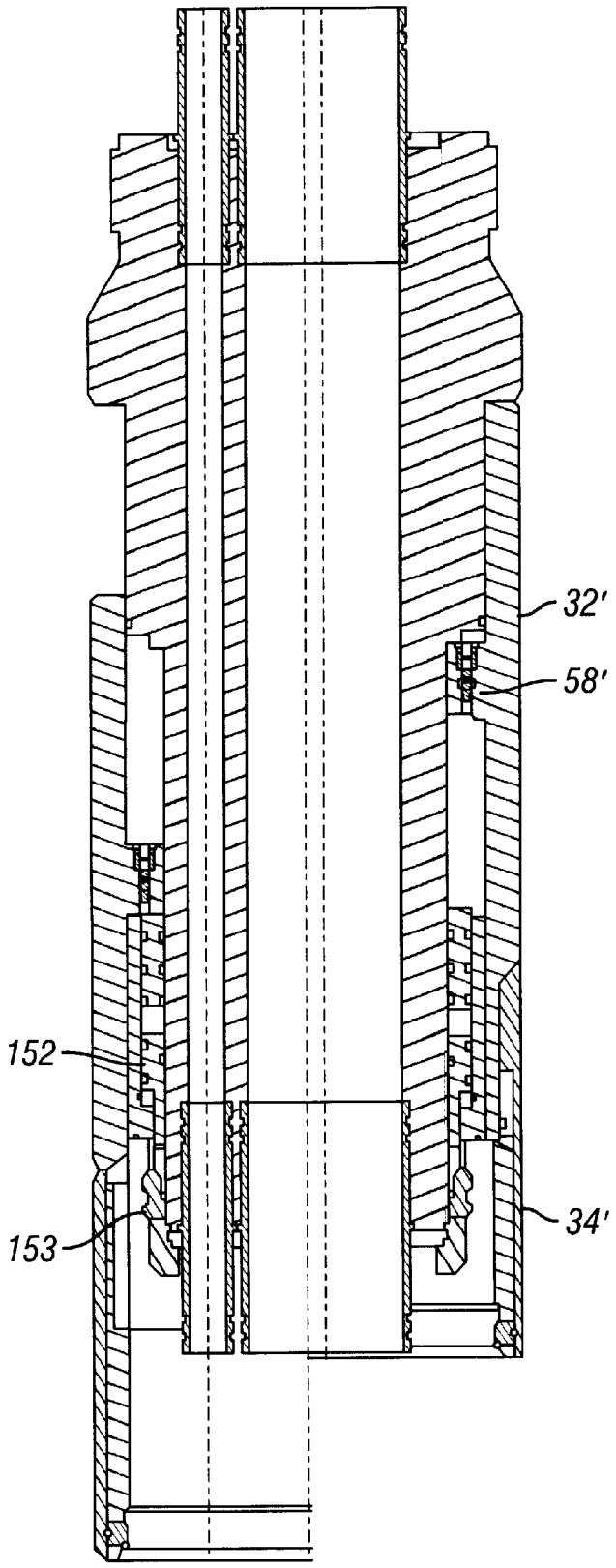

A tubing hanger running tool 151, which is adapted to activate the slidable gates and lost motion dogs used in the invention, is shown in a longitutional section view in FIG. 7(*a*). The running tool is shown in interfacing relation with a tubing hanger shown in FIG. 7(*b*) and provided with passages 154 to 158, a stroke indicator (relief valve) 58, a lock piston 32, a gate piston 34, positioned as shown in the apparatus of FIG. 2, a latch piston 152, and a latch ring 153. As interfaced with the tubing hanger, the passage 154 in the tool communicates with passage 154*a* in the lock piston and is used for applying hydraulic pressure to lock the tubing hanger to the wellhead. Passage 156 in the tool opens to the annulus above the latch piston 152 and is used to drive the latch piston downward when hydraulic pressure is applied therethrough. Passage 157 in the tool communicates with passage 157*a* in the latch piston and is used to unlatch from the tubing hanger. Passage 155 in the tool communicates with passage 155*a* for testing the latch to the hanger. The passages 155*a* and 157*a* extend through the latch piston 152 and open at the lower end thereof. Passage 158 in the tool opens directly below the stroke indicator valve 58 and is used for transmission of hydraulic pressure to unlock the tubing hanger from the wellhead.

As seen in FIG. 5, it is to be noted that the gate piston 34 can be driven downwardly to urge the gate dog 36 inwardly to clamp against the gate 138 when the gate is engaged by the gate dog. By hydraulically controlling pressures, the various pistons can be selectively and relatively moved to control the direction and degree of gate movement.

In FIG. 5, it will be seen that passage 81 provides for transmission of hydraulic pressure to port 73 directly above the relief valve, and passage 83 is provided to deliver hydraulic pressure to and from the port 76.

It is to be appreciated therefore, that the present invention employs gate valve technology to obviate the need for annular seals. The immediate result of this arrangement is that the tree and completion can be run and/or retrieved independently.

The inner seal seals between the tubing hanger body and the inside of the gate. With the gate in its uppermost position, the outlet is blanked off, a function similar to that of a gate and seat in a gate valve. This eliminates the need for a wireline retrievable isolation sleeve for well control while running the completion. It also isolates the outlet should the tree not be in place.

As the gate is forced downwardly, the lost motion dog pushes a support sleeve under the lock ring to lock the tubing hanger to the wellhead housing. Continued downward motion disengages the lost motion dog and extends the outer seal radially to seal against the tree stalk bore. It is important to note that these operations are independent. By controlling the amount of downward stroke, the tubing hanger can be locked to the wellhead housing without extending the outer seal. This allows the completion to be run and the rig to be moved off location prior to running the tree. Conversely, by limiting the upward stroke of the gate, the tubing hanger can remain locked to the wellhead housing while the outer seals are retracted to allow the tree to be recovered. Since the fine alignment slot passes between seals, the alignment key in the tree stalk bore does not impede installation or recovery in either scenario.

Further, it is to be appreciated that the invention assembly can be used to run or retrieve both the tubing hanger and tree cap. Applying pressure to the "lock tubing hanger to wellhead" circuit forces the lock piston downwardly to actuate the tubing hanger/tree cap lock/seal functions. This pressure is also routed to the lower side of the gate piston to retract the gate dogs. Maximum downward travel opens a check valve in the stroke indicator assembly allowing communication with the "unlock tubing hanger from wellhead" circuit. Pressure applied to the latter reverses these actions. The latch piston is forced under the latch ring by pressuring the "latch to tubing hanger" circuit and is reversed by pressuring the "unlatch from tubing hanger" line. With the latch piston in its downmost position, two seals straddle the "test latch to tubing hanger" port to allow confirmation. Note that the latch piston is overbalanced to insure maintenance of latch if hydraulics are lost.

It is also to be understood that the foregoing description of a preferred embodiment of the invention has been presented for purposes of illustration and explanation and is not intended to limit the invention to the precise apparatus or steps of the method disclosed herein. For example, the number of ports and gates in the assembly may vary in the assembly from what is disclosed. It is to be appreciated therefore that changes may be made by those skilled in the art without departing from the spirit of the invention.

What is claimed is:

1. A subsea wellhead completion system comprising:

a wellhead housing having a wellhead internal bore and adapted to be supported on a seabed;

a tree disposed above and mounted said wellhead housing, said tree having an tree internal bore and a fine alignment key for aligning said tree with said wellhead housing;

connecting means for connecting said tree to said wellhead housing and providing fluid communication between said tree internal bore and said wellhead internal bore;

a tubing hanger disposed in said tree internal bore and having a production tubing string and an annular tubing string extending downwardly therefrom;

said tree having a plurality of ports selected from the group comprising:

at least one radial production port for communication of said bore with an external production line;

at least one annular access port for communication of said bores with an annular access line; and at least one additional port for hydraulic connection to said internal bore;

said tubing hanger further having gate means, said gate means comprising slidably engagable gates, each gate having a gate port, and wherein said gates are moveable to open and close one or more of said production port, said annular access port, and said additional port;

means comprising a running tool deployable in communication and operative association with said tubing hanger whereby said running tool can manipulate said slidably engagable gates and wherein said tubing hanger comprising said slidably engagable gates is in communication with a means for relatively retracting or extending outer seals of said tubing hanger and wherein said gates are moveable in a direction parallel to the axis of the tubing hanger to thereby cam said means for retracting or extending in a direction perpendicular to the axis of said tubing hanger to thereby extend or retract said outer seals of each bore, said means for retracting or extending further providing axial sliding movement of said gates between said production port, said annular access port and said additional port, providing alternatively, a blocking position sealing against an inner seal and an unblocking position for fluid communication with each of said ports, said tubing hanger and said tree.

2. The system of claim 1, further comprising a lost motion dog to prevent the disengagement of said tubing hanger while said outer seal is retracted for enabling said tree to be removed from said subsea wellhead without damage to said outer seals.

3. A method for servicing a subsea well, said well comprising a wellhead housing supported on a seabed, a tree disposed above and removably connected to said wellhead housing, said tree having an internal bore, a fine alignment key for aligning said tree with said wellhead housing, and a plurality of ports selected from the group comprising:

at least one radial production port for communication of said bores with an external production line;

at least one annular access port for communication of said bores with an annular access line; and at least one additional port for hydraulic connection to said internal bore;

a tubing hanger disposed in said internal bore of said tree and having a production tubing string extending downwardly therefrom, and an annular tubing string extending downwardly therefrom, said tubing hanger further comprising slidably engagable gates each with a gate port and wherein said gates are moveable to selectively open and close at least one of said ports, said method comprising the steps of:

a. engaging at least one of said slidably engagable gates in an axial motion to apply pressure against a means for retracting or extending outer seals for said ports;

b. camming against said means for retracting or extending at least one outer seals causing motion perpendicular to the motion of said slidably engagable gate thereby retracting or extending said at least one outer seal for said outer port;

c. maintaining an inner contact using said slidably engagable gate having a port disposed therein, to alternatively provide a blocking position by engaging said gate with an inner seal and an unblocking position by aligning said gate port with at least one of said production port, said annular access port, and said additional port for fluid communication with the tubing hanger and the tree; and d. when in the blocked position, removing said tree from said wellhead housing while said tubing hanger remains engaged to said production tubing string.

4. The method of claim 3, further including the steps of:

a. reconnecting said tree to said wellhead housing; and b. moving said slidably engagable gate from said blocking position to an unblocking position, thereby providing fluid communication with said tree and said tubing hanger.

5. A method for servicing a subsea well, said well comprising a wellhead housing supported on a seabed; a tree disposed above and removably connected and aligned with said wellhead housing, said tree having an internal bore, a plurality of ports comprising;

at least one radial production port for communication of aid bores with an external production line;

at least one annular access port for communication of said bores with an annular access line; and at least one additional port for hydraulic connection to said internal bore;

a tree cap with a tree cap internal bore in fluid communication with said tree, a tubing hanger disposed in said internal bore of said tree and having a production tubing string extending downwardly therefrom, and an annular tubing string extending downwardly therefrom, said tubing hanger further comprising slidably engagable gates each with a gate port, and wherein said gates open and close said production port, said annular access port and said additional port; said method comprising the steps of:

a. engaging at least one of said slidably engagable gates in an axial motion to apply pressure against a means for retracting or extending outer seals for said ports;

b. camming against said means for retracting or extending at least one outer seal causing motion perpendicular to the motion of said slidably engagable gate thereby retracting or extending said at least one outer seal for said outer port;

c. maintaining an inner contact using said slidably engagable gate having a port disposed therein, to alternatively provide a blocking position, by engaging said gate with an inner seal and an unblocking position by aligning said gate port with at least one of said production port, said annular access port, and said additional port for fluid communication with the tubing hanger and the tree;

d. disconnecting said tree cap from said tree and said tubing hanger; and e. using a running tool to pull said tubing hanger from said wellhead by manipulating said slidably engagable gates in an axial direction to retract said outer seals and through the use of a lost motion dog, disconnecting said tubing hanger from said wellhead.

6. The method of claim 5, wherein said running tool is used to redeploy said tree cap and said tree cap is reconnected to said wellhead.

7. The method of claim 5, wherein said running tool is used to re-deploy said tubing hanger by manipulating said gates to lock said tubing hanger to said wellhead through the use of said lost motion dog and said outer seals and creating a fluid communication between production port, annular access port and said additional port with said gate port.

* * * * *